US009953758B2

(12) United States Patent
Tong et al.

(10) Patent No.: US 9,953,758 B2
(45) Date of Patent: Apr. 24, 2018

(54) MAGNETIC ELEMENT

(71) Applicant: Delta Electronics (Shanghai) Co., Ltd., Shanghai (CN)

(72) Inventors: Ai-Xing Tong, Shanghai (CN); Teng Liu, Shanghai (CN)

(73) Assignee: DELTA ELECTRONICS (SHANGHAI) CO., LTD., Shanghai (CN)

( * ) Notice: Subject to any disclaimer, the term of this patent is extended or adjusted under 35 U.S.C. 154(b) by 276 days.

(21) Appl. No.: 14/693,271

(22) Filed: Apr. 22, 2015

(65) Prior Publication Data

US 2015/0310976 A1 Oct. 29, 2015

(30) Foreign Application Priority Data

Apr. 25, 2014 (CN) ..... 2014 1 0171035

(51) Int. Cl.

| | |
|---|---|
| ***H01F 27/08*** | (2006.01) |
| ***H01F 27/02*** | (2006.01) |
| ***H01F 27/26*** | (2006.01) |
| ***H01F 27/18*** | (2006.01) |
| *H01F 27/34* | (2006.01) |

(52) U.S. Cl.

CPC ..... *H01F 27/263* (2013.01); *H01F 27/18* (2013.01); *H01F 27/346* (2013.01)

(58) Field of Classification Search

USPC ..... 336/55–61

See application file for complete search history.

(56) References Cited

U.S. PATENT DOCUMENTS

| | | | | |
|---|---|---|---|---|
| 2,547,065 A | | 4/1951 | Wadhams | |
| 3,183,461 A | * | 5/1965 | Tipton | H01F 27/08 336/212 |
| 3,774,298 A | * | 11/1973 | Eley | H01F 27/322 264/272.19 |
| 7,893,804 B2 | * | 2/2011 | Kaveh Ahangar | H01F 27/10 336/60 |
| 2003/0030526 A1 | * | 2/2003 | Hirai | H01F 17/045 336/83 |
| 2007/0295715 A1 | | 12/2007 | Saka et al. | |

(Continued)

FOREIGN PATENT DOCUMENTS

| | | |
|---|---|---|
| CN | 1070786 A | 4/1993 |
| CN | 1202708 A | 12/1998 |

(Continued)

*Primary Examiner* — Mangtin Lian
*Assistant Examiner* — Kazi Hossain
(74) *Attorney, Agent, or Firm* — CKC & Partners Co., Ltd.

(57) ABSTRACT

A magnetic element is disclosed, and includes a magnetic core, at least one winding set and at least one heat conduction pipe. The magnetic core includes two magnetic columns arranged oppositely, and two magnetic plates arranged oppositely. The magnetic plates respectively cover two opposite end surfaces of each magnetic column to mutually form a closed magnetic flux path with the magnetic columns. Each of the magnetic columns includes a plurality of first magnetic blocks stacked together. Each of the magnetic plates includes at least one second magnetic block. The winding set binds one of the magnetic columns. The heat conduction pipe is disposed internally in one of the magnetic columns.

24 Claims, 10 Drawing Sheets

(56) References Cited

U.S. PATENT DOCUMENTS

| | | | | |
|---|---|---|---|---|
| 2008/0055034 | A1* | 3/2008 | Tsunemi | H01F 3/10 336/83 |
| 2012/0075047 | A1* | 3/2012 | Luckey | H01F 27/25 336/60 |
| 2012/0139683 | A1* | 6/2012 | Salomaki | H01F 27/10 336/61 |
| 2012/0206232 | A1* | 8/2012 | Yamamoto | H01F 3/14 336/210 |
| 2012/0268227 | A1* | 10/2012 | Howes | F28D 15/0266 336/57 |
| 2014/0132380 | A1* | 5/2014 | Jacobson | H01F 27/025 336/60 |

FOREIGN PATENT DOCUMENTS

| | | | |
|---|---|---|---|
| CN | 102473506 | A | 5/2012 |
| JP | 2010-056237 | A | 3/2010 |

* cited by examiner

MAGNETIC ELEMENT

RELATED APPLICATIONS

This application claims priority to China application no. 201410171035.1, filed, Apr. 25, 2014, the entirety of which is incorporated herein by reference.

BACKGROUND

Technical Field

The present disclosure relates to a magnetic element. More particularly, the present disclosure relates to a magnetic element which can enhance thermal dissipation performance thereof.

Description of Related Art

With the power electronics systems, e.g., wind power inverters, solar energy inverters, medium/high voltage inverters, uninterruptible power systems (UPS), power quality management equipments and etc., are widely used, the thermal dissipation performance of the power electronic systems are increasingly emphasized.

Magnetic elements, the critical components of the power electronic systems, have main functions including isolation and limitation of short circuit current thereof, reactive power compensation and flat wave. Since the magnetic elements consume power and convert the power into heat when the magnetic elements are working, the magnetic elements may overheat and malfunction in surrounding of high temperature. Therefore, in order to keep the magnetic elements working properly, the magnetic elements are generally cooled down to decrease the external temperatures of the magnetic elements through, for example, liquid-cooling radiators or air-cooling radiators.

To enhance thermal dissipation efficiency of the magnetic elements, those of skills in the related art all devote themselves in finding suitable solutions. However, no appropriate solution has ever been developed or completed. Therefore, how to effectively enhance thermal dissipation efficiency thereof shall be one of current significant research issues, and also be an objective that urgently needs to be improved.

SUMMARY

One aspect of this disclosure is to provide a magnetic element for enhancing the thermal dissipation performance of the magnetic element, so as to overcome the above-mentioned disadvantages existing in the prior art.

The magnetic element provided in the disclosure is applicable in products of all kinds of power electronics systems (e.g., reactors or transformers), or applicable widely in related technology chains. No matter whether the thermal conductivity of the magnetic element of the disclosure is high or not, the above-mentioned features of the disclosure is allowed to enhance the thermal dissipation performance of the magnetic element, thereby reducing the failure risk of the magnetic element when overheated, and increasing load capacity, service life and reliability of the magnetic element.

To achieve the above object, according to one embodiment of this disclosure, the magnetic element includes a magnetic core, at least one winding set and at least one heat conduction pipe. The magnetic core includes at least two magnetic columns arranged oppositely, and two magnetic plates arranged oppositely. Each of the magnetic columns includes a plurality of first magnetic blocks stacked together. The magnetic plates respectively cover two opposite end surfaces of each magnetic column to mutually form a closed magnetic flux path with the magnetic columns. Each of the magnetic plates includes at least one second magnetic block. The winding set binds at least one of the magnetic columns. The heat conduction pipe is disposed in an interior of one of the magnetic columns.

By the above-mentioned features of the magnetic element, since the heat conduction pipe is internally disposed in the magnetic columns, internal heat of the magnetic column can be rapidly conducted away from the magnetic element by the heat conduction pipe, and the internal heat then can be carried away by external cooling air or liquid. The internal heat of the magnetic column can be taken away by external cooling air or liquid before being conducted to outer surfaces of the magnetic columns. Thus, the temperature of the magnetic element can be quickly decreased so as to further significantly increase load capacity, service life and reliability of the magnetic element.

These and other features, aspects, and advantages of the present disclosure will become better understood with reference to the following description, accompanying drawings and appended claims.

It is to be understood that both the foregoing general description and the following detailed description are by examples, and are intended to provide further explanation of the disclosure as claimed.

BRIEF DESCRIPTION OF THE DRAWINGS

The present disclosure will be apparent to those skilled in the art by reading the following detailed description of a preferred embodiment thereof, with reference to the attached drawings, in which.

DETAILED DESCRIPTION

The following embodiments are disclosed with accompanying diagrams for detailed description. For illustration clarity, many details of practice are explained in the following descriptions. However, it should be understood that these details of practice do not intend to limit the present disclosure. That is, these details of practice are not necessary in parts of embodiments of the present disclosure. Furthermore, for simplifying the drawings, some of the conventional structures and elements are shown with schematic illustrations.

The terminology used herein is for the purpose of describing particular embodiments only and is not intended to be limiting of the invention. As used herein, the singular forms "a", "an" and "the" are intended to include the plural forms as well, unless the context clearly indicates otherwise.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

First Embodiment

Figure 1:
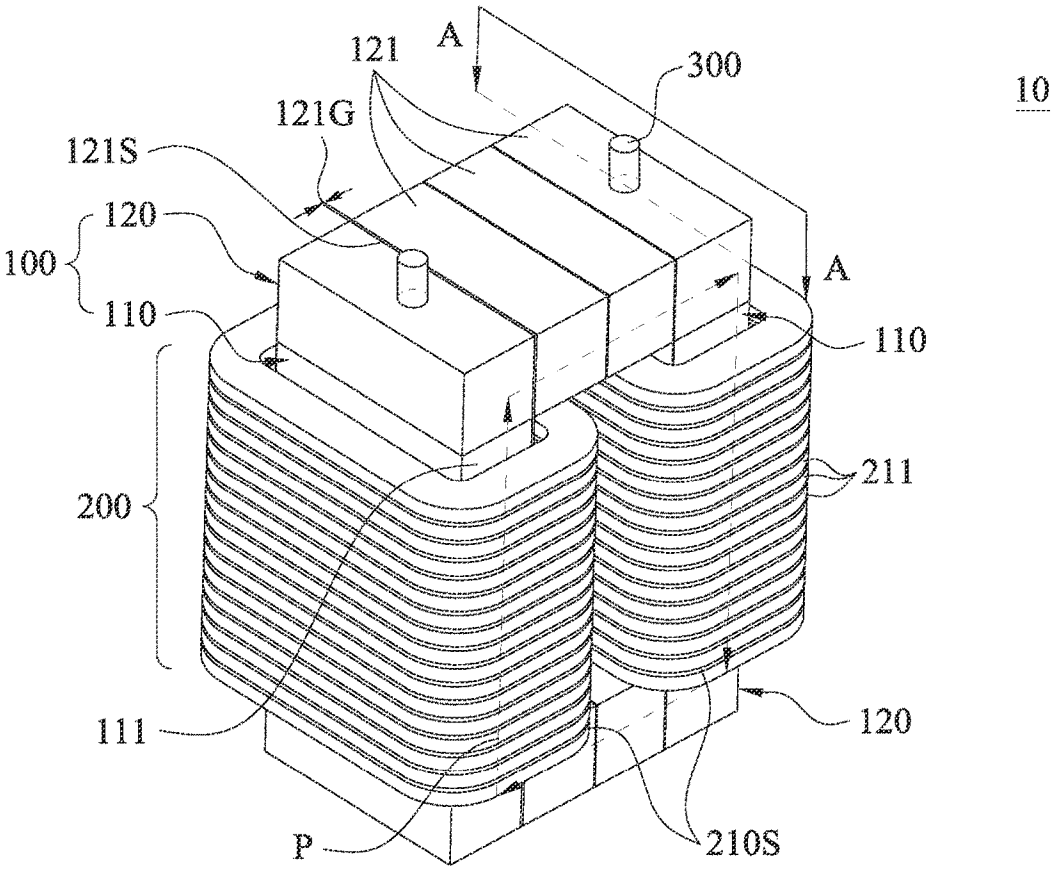
FIG. 1 is a perspective view of a magnetic element according to a first embodiment of the disclosure.
Figure 2:
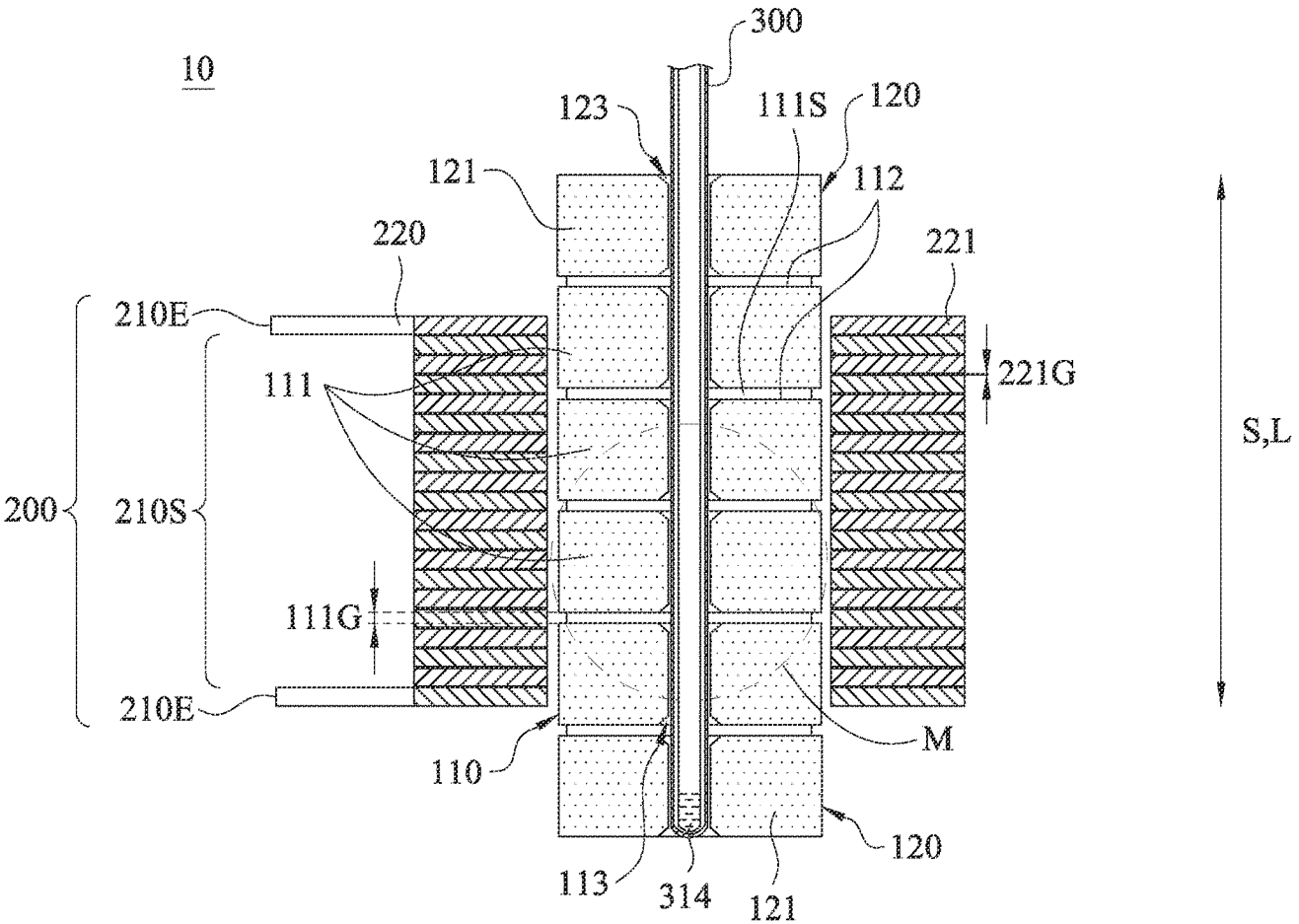
FIG. 2 is a cross sectional view of FIG. 1 taken along line AA.

Reference is now made to FIG. 1 and FIG. 2. FIG. 1 is a perspective view of a magnetic element 10 according to a first embodiment of the disclosure, and FIG. 2 is a cross sectional view of FIG. 1 taken along line AA. As shown in FIG. 1 and FIG. 2, the magnetic element 10 includes a magnetic core 100, winding sets 200 and heat conduction pipes 300. The magnetic core 100 includes at least two magnetic columns 110 and at least two magnetic plates 120. The magnetic columns 110 are arranged oppositely, and each of the magnetic columns 110 includes a plurality of first magnetic blocks 111 stacked together (FIG. 2). The magnetic plates 120 are arranged oppositely. The magnetic plates 120 respectively cover two opposite end surfaces of each magnetic column 110 to mutually form a closed magnetic flux path P with the magnetic columns 110. Each of the magnetic plates 120 includes a plurality of second magnetic blocks 121 stacked together. Of course, in another embodiment, each of the magnetic plates 120 can be composed of one second magnetic block. Each of the winding set binds one of the magnetic columns 110. Each of the heat conduction pipes 300 is at least disposed in an interior of one of the magnetic columns 110.

Therefore, with the above-mentioned features, since each of the heat conduction pipes 300 is internally disposed in one of the magnetic columns 110, an internal heat generated inside the magnetic column 110 can be rapidly conducted away the magnetic column 110 from the interior of the magnetic column 110 by the heat conduction pipe 300, and the internal heat then is carried away by external cooling air or liquid. The internal heat of the magnetic column 110 can be taken away by external cooling air or liquid before being conducted to the outer surfaces of the magnetic columns 110.

Therefore, no matter whether the thermal conductivity of the magnetic core 100 itself is high or not, the above-mentioned features of the magnetic element 10 can enhance the thermal dissipation performance of the magnetic element 10, thereby reducing the failure risk of the magnetic element 10 when being over-heated, and increasing load capacity, service life and reliability of the magnetic element 10.

In the first embodiment, the first magnetic blocks 111 (e.g., four first magnetic blocks, FIG. 2) of each magnetic column 110 are stacked together to form the magnetic column 110 according to a single column arrangement. The second magnetic blocks 121 (e.g., four second magnetic blocks, FIG. 1) of each magnetic plate 120 are stacked together to form the magnetic plate 120 according to a single row arrangement. Therefore, the outermost two of the second magnetic blocks 121 of each of the magnetic plates 120 respectively cover the outermost one of the first magnetic blocks 111 of the respective magnetic columns 110 on the same side with the corresponding magnetic plates 120, so that the magnetic columns 110 and the magnetic plates 120 mutually form a closed magnetic flux path P shaped as a rectangular ring. Among the first magnetic blocks 111 of each of the magnetic columns 110, every two of the adjacent first magnetic blocks 111 are usually bonded together by an adhesive part 112 (e.g., epoxy adhesives, thermal conductive adhesives or heat resistant adhesive). The magnetic columns 110 and the magnetic plates 120 are bonded together by adhesive parts 112 (e.g., epoxy adhesives, thermal conductive adhesives or heat resistant adhesive). More particularly, one of the first magnetic blocks 111 and one of the second magnetic blocks 121 being adjacent thereto are bonded together by the adhesive part 112.

Among the second magnetic blocks 121 of each of the magnetic plates 120, every two of the adjacent second magnetic blocks 121 are usually bonded together by an adhesive part 112 (e.g., epoxy adhesives, thermal conductive adhesives or heat resistant adhesive). However, the disclosure is not limited to the described features above, the magnetic blocks can be bonded together by other conventional bonding ways instead.

As shown in FIG. 2, every two of the adjacent first magnetic blocks 111 have a first non-magnetic conduction layer 111S disposed therebetween. Each of the first non-magnetic conduction layers 111S is sandwiched between every two adjacent first magnetic blocks 111 so that every two adjacent first magnetic blocks 111 can maintain a certain distance one another to define a first gap 111G for an air gap. Each of the first non-magnetic conduction layers 111S includes non-magnetic material, for example, insulation papers or epoxy boards. Similarly, as shown in FIG. 1, every two of the adjacent second magnetic blocks 121 have a second non-magnetic conduction layer 121S disposed therebetween. Each of the second non-magnetic conduction layers 121S is sandwiched between every two adjacent second magnetic blocks 121 so that every two adjacent second magnetic blocks 121 can maintain a certain distance one another to define a second gap 121G for an air gap. Each of the second non-magnetic conduction layers 121S includes non-magnetic material, for example, insulation papers or epoxy boards.

Therefore, when plural air gaps are respectively defined between the first magnetic blocks 111, and between the second magnetic blocks 121, the inductance of the magnetic element 10 can be adjusted by changing the size of the air gaps.

Figure 3:
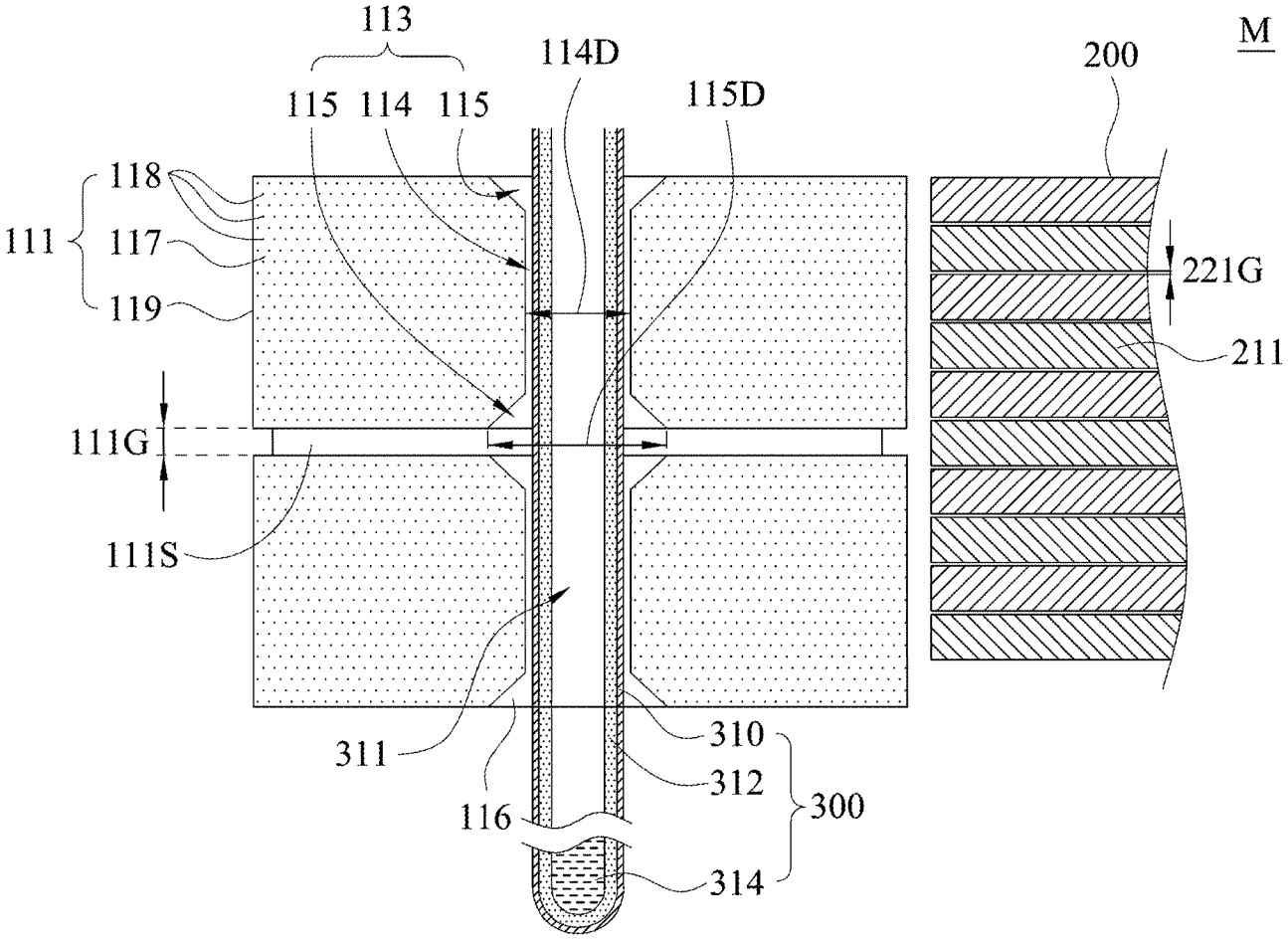
FIG. 3 is a partially enlarged view of a segment M of FIG. 2.

FIG. 3 is a partially enlarged view of a segment M of FIG. 2. As shown in FIG. 3, more particularly, each of the first magnetic blocks 111 includes an adhesive body 117, a plurality of metal magnetic particles 118 and an insulating cover layer 119. The metal magnetic particles 118 are distributed in the adhesive body 117. The insulating cover layer 119 wraps on outer surfaces of the adhesive body 117 for isolating vortex thereof so as to avoid skin effect. For example, each of the first magnetic blocks 111 is soft magnetic block shaped material, and the soft magnetic block shaped material is made by several steps of mixing the metal magnetic particles 118 and adhesive glues and pressing them to form a block part, processing the block part by heat treatments, next, using insulation materials to cover the outer surfaces of the block part. Moreover, the material and the making method of the first magnetic blocks are same as the material and the making method of the second magnetic blocks, refer to the above-mentioned first magnetic blocks, thus no further illustration is provided.

Furthermore, in the first embodiment, the first magnetic blocks and the second magnetic blocks can be made to be the same in sizes and appearances, so as to be convenient for production and storing, and thereby reducing production cost.

However, if the cost consideration is not necessary, the first magnetic blocks and the second magnetic blocks can be made to be different in sizes and appearances. Also, the appearances of the first magnetic blocks and the second magnetic blocks are not limited to the features described above, one person with ordinary skill in the art could flexibly modify the first magnetic blocks and the second magnetic blocks to be rectangular, cylindrical or semi-cylindrical in shape.

Refer to FIG. 2, the heat conduction pipe 300 penetrates through the first magnetic blocks 111 of the magnetic column 110, in other words, the first magnetic blocks 111 being stacked together are penetrated through by the same heat conduction pipe 300. The first magnetic blocks 111 being penetrated through by the same heat conduction pipe 300 extend in a stacking direction S. The heat conduction pipe 300 is in a straight shape, and extends in a length direction L. The stacking direction S of the magnetic column 110 and the length direction L of the heat conduction pipe 300 are the same so as to ensure that the heat conduction pipe 300 can straightly penetrate through all of the first magnetic blocks 111 of the magnetic column 110 which are stacked in the same row. Thus, the internal heat of the first magnetic blocks 111 can be conducted away from the first magnetic blocks 111 through the heat conduction pipe 300. Although the thermal conductivity of the magnetic core 100 of this embodiment is not high, the internal heat of the first magnetic blocks 111 not easy to be conducted to the outer surfaces of the magnetic columns 110 can be further taken away the magnetic core 100 from the interior of the first magnetic blocks 111 by the conduction of the heat conduction pipe 300.

Moreover, since the internal heat of the magnetic column is not easy to be conducted to the outer surfaces of the magnetic columns 110 by the first magnetic blocks 111 themselves, and only an external heat on the outer surfaces of the magnetic columns 110 can be rapidly taken away, thus, in order to further enhance thermal dissipation performance of the heat conduction pipe 300, more specifically, the heat conduction pipe 300 substantially penetrates through from the centroids of all of the first magnetic blocks 111 of the magnetic columns 110. Thus, the heat conduction pipe 300 is located in a center (i.e., the innermost location) of every first magnetic block 111 so as to totally take much more internal heats away from the first magnetic blocks 111.

Refer to FIG. 2, in order to enhance thermal dissipation performance thereof, both of the magnetic columns 110 and the magnetic plates 120 are penetrated through by the heat conduction pipe 300 so that internal heat of the magnetic plates 120 also can be rapidly conducted outwards the magnetic plates 120 from the interior of the magnetic plates 120 by the conduction of the heat conduction pipe 300. More particularly, two opposite ends of the heat conduction pipe 300 penetrating through the first magnetic blocks 111 respectively penetrate through the interior of the second magnetic blocks 121 of the respective magnetic plate 120.

However, it is noted, the described quantity, location and the shape of the heat conduction pipe described above are only for illustration, not for limiting the disclosure. One person with ordinary skill in the art may flexibly modify the heat conduction pipe contained in the magnetic columns in quantity (e.g., plural), location (e.g., deviation from the centroid of the heat conduction pipe) or/and shape (e.g., arc shaped).

In practice, refer to FIG. 2, in order to have the heat conduction pipe 300 smoothly penetrating through each of the first magnetic blocks 111 and each of the second magnetic blocks 121 covering the first magnetic blocks 111, each of the first magnetic blocks 111 is provided with at least one first through hole 113 which extends in the stacking direction S. Each of the second magnetic blocks 121 covering the first magnetic blocks 111 is provided with at least one second through hole 123 which extends in the stacking direction S. The first through holes 113 of the first magnetic blocks 111 are in communication with each other, and the first through holes 113 are the same, or at least substantially the same in caliber. Similarly, the second through holes 123 are in communication with the first through holes 113 of the first magnetic blocks 111, and the calibers of the second through holes 123 and the first through holes 113 are respectively the same, or at least substantially the same. Therefore, the heat conduction pipe 300 can smoothly penetrate through all of the first through holes 113 and the second through holes 123 which are in communication with the first through holes 113. Thus, the heat conduction pipe 300 is simultaneously disposed in the first through holes 113 which are in the same magnetic column 110 and in communication with each other, and the second through holes 123.

In this embodiment, refer to FIG. 3, each of the first through holes 113 includes a middle section 114 and two openings 115. The middle section 114 is located in the respective first magnetic block 111, and the middle section 114 has a caliber 114D having a single size. The openings 115 are respectively located at two opposite ends of the middle section 114, and the two openings are respectively disposed on two opposite end surfaces of the respective first magnetic block 111. A maximum caliber 115D of each of the openings 115 is greater than the caliber 114D of the middle section 114. Moreover, the first through holes and the second through holes are structurally the same, refer to the above-mentioned middle section and openings, thus no further illustration is provided.

Furthermore, each of the openings 115 of each of the first through holes 113 includes a chamfer 116 therein. More concretely, the cross section of each of the openings 115 is formed with a chamfer 116, thus, the maximum caliber 115D of each of the openings 115 is greater than the caliber 114D of the middle section 114.

Therefore, when the chamfer 116 is formed in the first through holes 113 of the magnetic block, it is advantageous to reduce the intensity of diffusion flux generated on an intersection between the heat conduction pipe 300 and the air gap (i.e., first gap 111G), so as to further lessen induction heating of the magnetic flux leakage to the heat conduction pipe 300 for decreasing the loss of the energy.

In the first embodiment, refer to FIG. 2, with a mechanical expansion process, the heat conduction pipe 300 expands in size to be secured (e.g., interference fit) in the first through holes 113 and the second through holes 123 so that the heat conduction pipe 300 directly and tightly connects to the first magnetic blocks 111 and the second magnetic blocks 121 in the first through holes 113 and the second through holes 123.

Thus, when the magnetic element 10 is in operation, heat generated by the first magnetic blocks 111 and the second magnetic blocks 121 can be directly conducted to the heat conduction pipe 300 so that the efficiency that heat being conducted outwardly by the heat conduction pipe 300 can be enhanced.

As shown in FIG. 1, in these two magnetic columns 110, each of the magnetic columns 110 gets through a center of one of the winding sets 200, and being bound by the corresponding winding set 200. Each of the winding sets includes a plurality of turns 211, and the turns 211 surround the corresponding magnetic column 110.

More specifically, as shown in FIG. 2, each of the winding sets 200 includes a turn assembly 210S and terminal ends 210E respectively disposed at opposite ends of the turn assembly 210S. The turn assembly 210S is made by using a flat wire 220 continually surrounding the magnetic column 110 according to a vertical spiral wound mode to form the plural turns 211. The outer surfaces of the flat wire 220 are provided with an insulation layer 221. The insulation layer 221 normally is an insulating painted layer or an insulation tape, so as to allow the surfaces of every two adjacent turns 211 to be electrically isolated to each other. The material of the flat wire 220 normally is copper or aluminum. When the magnetic element 10 is in operation, heat generated from the winding sets 200 can be mainly taken away by cooling air passing through the outer surfaces of the winding sets 200 so as to cool the winding sets 200.

Also, in order to enhance the cooling efficiency, a turn spacing 221G is defined between every two of the adjacent turns 211 so as to increase contacting areas of the winding sets 200 being contacted by external cooling air for enhancing thermal dissipation performance of the winding sets 200.

Second Embodiment

Figure 4:
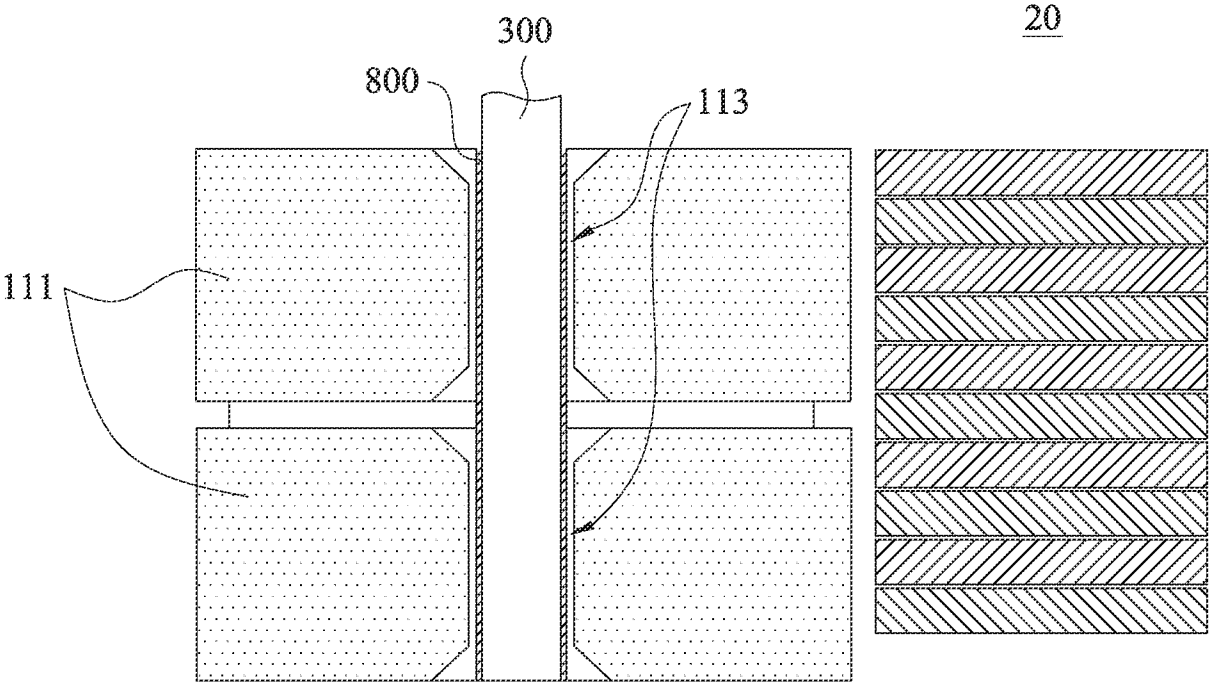
FIG. 4 is a partially enlarged view of a magnetic element according to a second embodiment of the disclosure, wherein the enlarged location of the magnetic element is the same as FIG. 2.

FIG. 4 is a partially enlarged view of a magnetic element 20 according to a second embodiment of the disclosure, wherein the enlarged location of the magnetic element is the same as the segment M of FIG. 2. As shown in FIG. 4, the magnetic element 20 of the second embodiment of the disclosure is substantially the same as the magnetic element 10 of the first embodiment thereof, except that the heat conduction pipe 300 is bonded in the first through holes 113 by a thermally conductive adhesive 800. In other words, both of the thermally conductive adhesive 800 and the heat conduction pipe 300 are disposed in the first through holes 113 at the same time, and the thermally conductive adhesive 800 is disposed between the heat conduction pipe 300 and the first magnetic blocks 111, and the heat conduction pipe 300 is fixed in the first through holes 113 through the thermally conductive adhesive 800.

Therefore, the thermally conductive adhesive 800 is used to hold the heat conduction pipe 300 in the first through holes 113 on the one hand, and is used to conduct the internal heat of the first magnetic blocks 111 to the heat conduction pipe 300 on the other hand. The heat conduction pipe of the second embodiment is also bonded in the second through holes by the thermally conductive adhesive. Please refer to the described features, thus no further illustration is provided.

Third Embodiment

Figure 5:
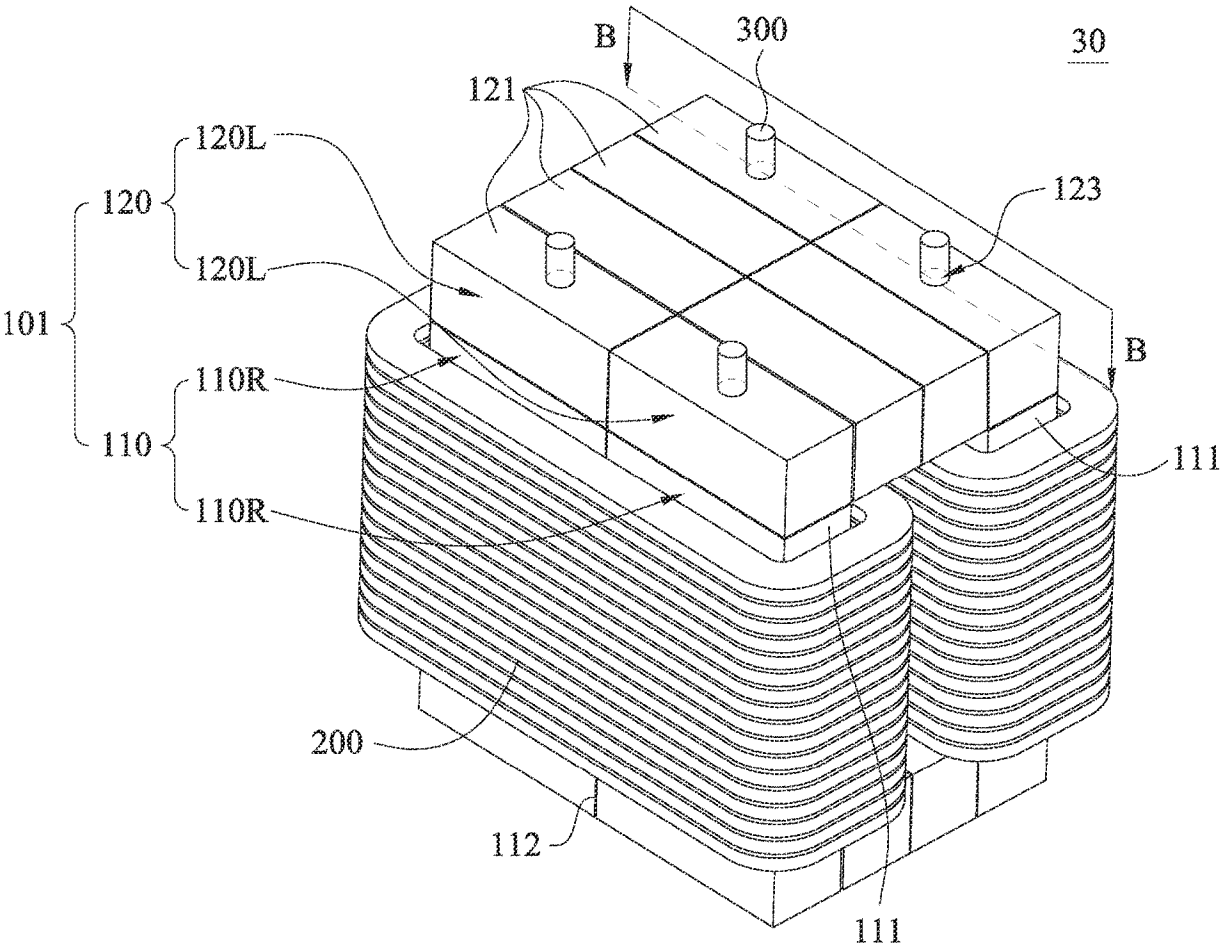
FIG. 5 is a perspective view of a magnetic element according to a third embodiment of the disclosure.
Figure 6:
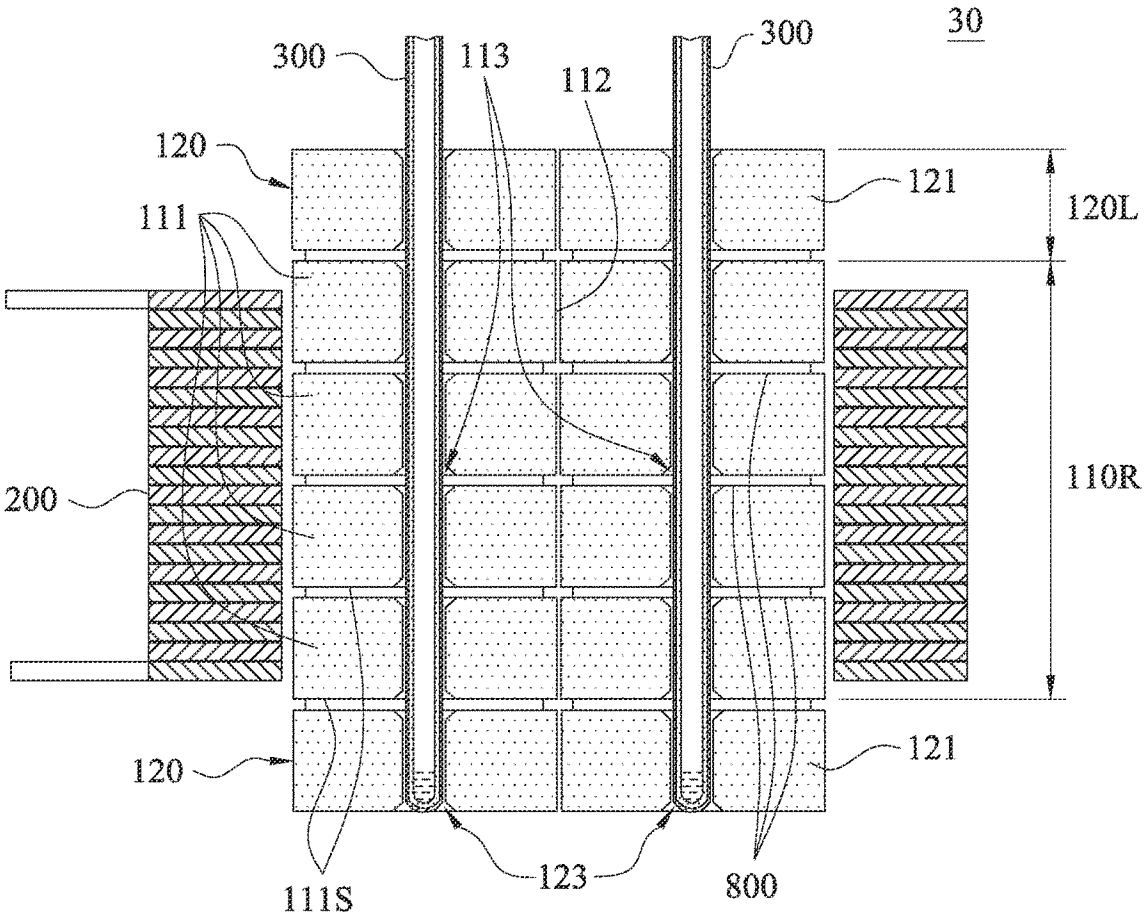
FIG. 6 is a cross sectional view of FIG. 5 taken along line BB.

Reference is now made to FIG. 5 and FIG. 6. FIG. 5 is a perspective view of a magnetic element 30 according to a third embodiment of the disclosure, and FIG. 6 is a cross sectional view of FIG. 5 taken along line BB. As shown in FIG. 5 and FIG. 6, the magnetic core 101 of the magnetic element 30 in the third embodiment is formed by plural magnetic cores 100 in the first embodiment. For example, one of the magnetic columns 110 of the magnetic element 30 in the third embodiment is made by stacking the first magnetic blocks 111 together to form plural column parts which are arranged abreast. One of the magnetic plates 120 of the magnetic element 30 is made by stacking the second magnetic blocks 121 together to form plural row parts which are arranged abreast. Also, the magnetic core, the winding set and the heat conduction pipe of the first embodiment described above still can be applied in the third embodiment.

In the third embodiment, specifically, each of the magnetic columns 110 includes plural column parts 110R (e.g., two column parts, FIG. 5) which are arranged abreast. Each of the column parts 110R is made by the first magnetic blocks 111 (e.g., four first magnetic blocks, FIG. 6) stacked together according to a single column arrangement, that is, each of the magnetic columns 110 is made by these first magnetic blocks 111 stacked abreast into the column parts 110R. Each of the magnetic plates 120 includes plural row parts 120L (e.g., two row structures, FIG. 5) which are arranged abreast. Each of the row parts 120L is made by the second magnetic blocks 121 (e.g., four second magnetic blocks, FIG. 5) stacked together according to a single row arrangement, that is, each of the magnetic plates 120 is made by these second magnetic blocks 121 stacked abreast into the row parts 120L. Therefore, the outermost two of the second magnetic blocks 121 of each of the row parts 120L respectively cover the outermost one of the respective first magnetic block 111 on the same side with the corresponding row parts 120L so that the magnetic columns 110 and the magnetic plates 120 mutually form a closed magnetic flux path P (e.g., the magnetic flux path P of FIG. 1) shaped as a rectangular ring.

Similarly, every two of the adjacent row parts 120L, or every two of the adjacent column parts 110R are usually bonded together by an adhesive part 112 (e.g., epoxy adhesives, thermal conductive adhesives or heat resistant adhesive). However, the disclosure is not limited to the described features above, the row parts or the column parts can be bonded together by other conventional bonding ways instead.

Furthermore, each of the column parts 110R and the outermost one of the second magnetic blocks 121 of the corresponding row parts 120L on the same side with the corresponding column part 110R are penetrated by the same heat conduction pipe 300, therefore, as shown in FIG. 5, a quantity of the heat conduction pipe 300 being disposed in the interior of the same magnetic column 110 are plural. Thus, the thermal dissipation performance of the magnetic element 30 can be further improved.

Also, in the third embodiment, the heat conduction pipe 300 of the magnetic element 30 is not limited to use the described thermally conductive adhesive or the described mechanical expansion process for being fixed in both of the first magnetic blocks 111 and the second magnetic blocks 121.

Fourth Embodiment

Figure 7:
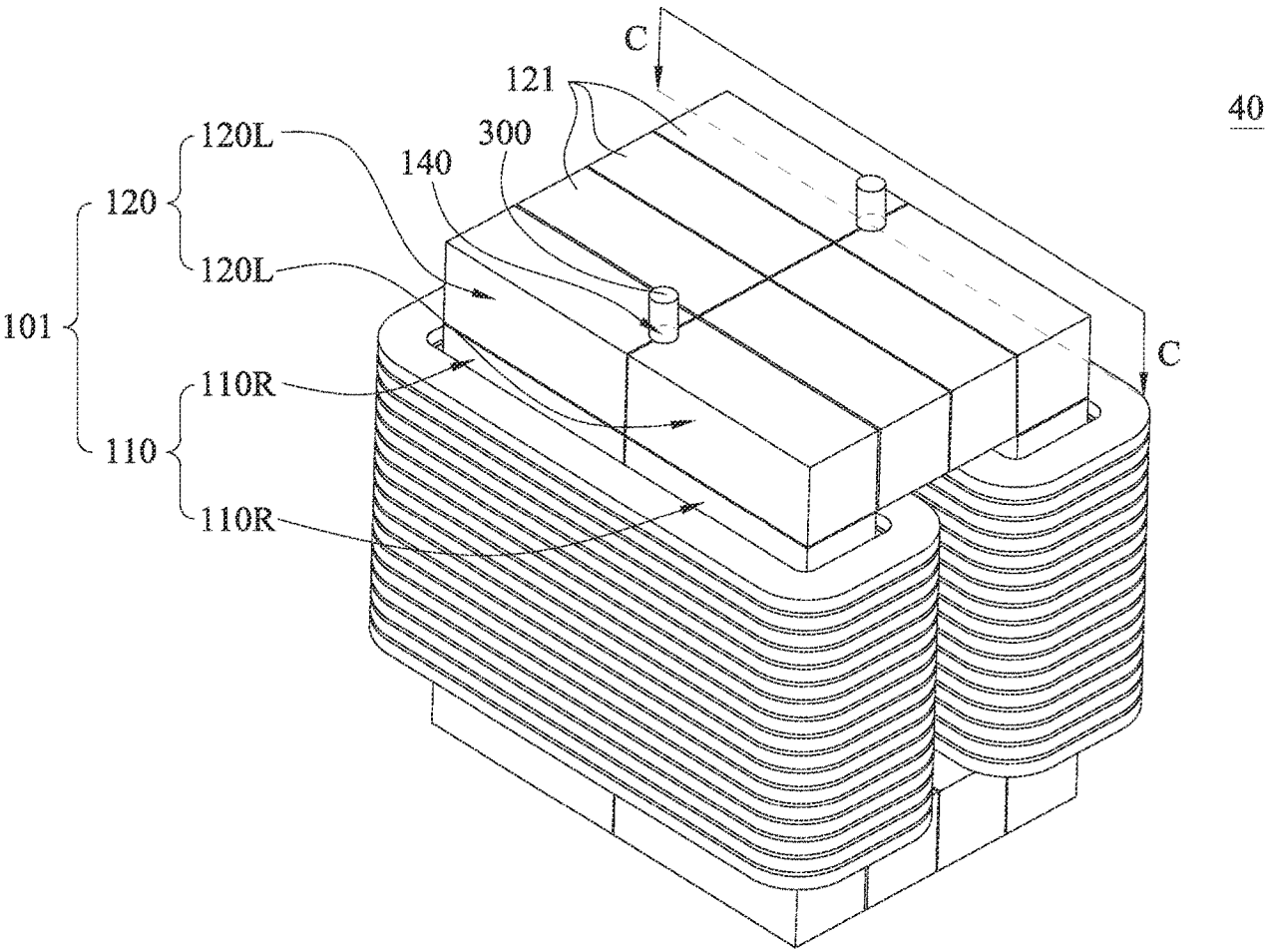
FIG. 7 is a perspective view of a magnetic element according to a fourth embodiment of the disclosure.
Figure 8:
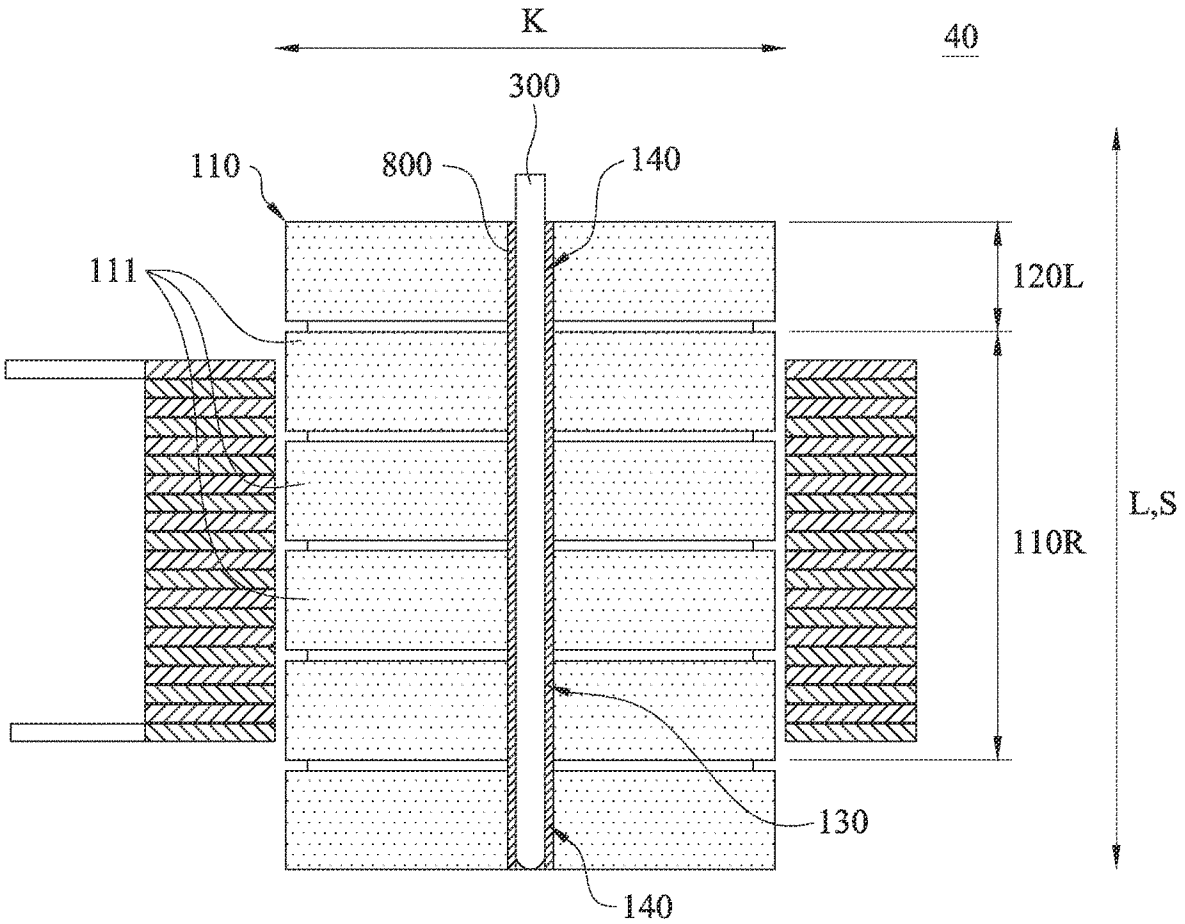
FIG. 8 is a cross sectional view of FIG. 7 taken along line CC.

Reference is now made to FIG. 7 and FIG. 8. FIG. 7 is a perspective view of a magnetic element 40 according to a fourth embodiment of the disclosure, and FIG. 8 is a cross sectional view of FIG. 7 taken along line CC. As shown in FIG. 7 and FIG. 8, the magnetic element 40 of the fourth embodiment of the disclosure is substantially the same as the magnetic element 30 of the third embodiment thereof, except that the heat conduction pipe 300 of the fourth embodiment is sandwiched between two adjacent ones of the column parts being mutually arranged abreast, and two adjacent ones of the row parts being mutually arranged abreast. On the other words, the heat conduction pipe 300 is sandwiched between two adjacent ones of the first magnetic blocks 111 structures being mutually arranged abreast, and two adjacent ones of the second magnetic blocks 121 being mutually arranged abreast. The length direction L of the heat conduction pipe 300, and an alignment direction K of the first magnetic blocks 111 and the second magnetic blocks arranged abreast are orthogonal to each other.

Figure 9:
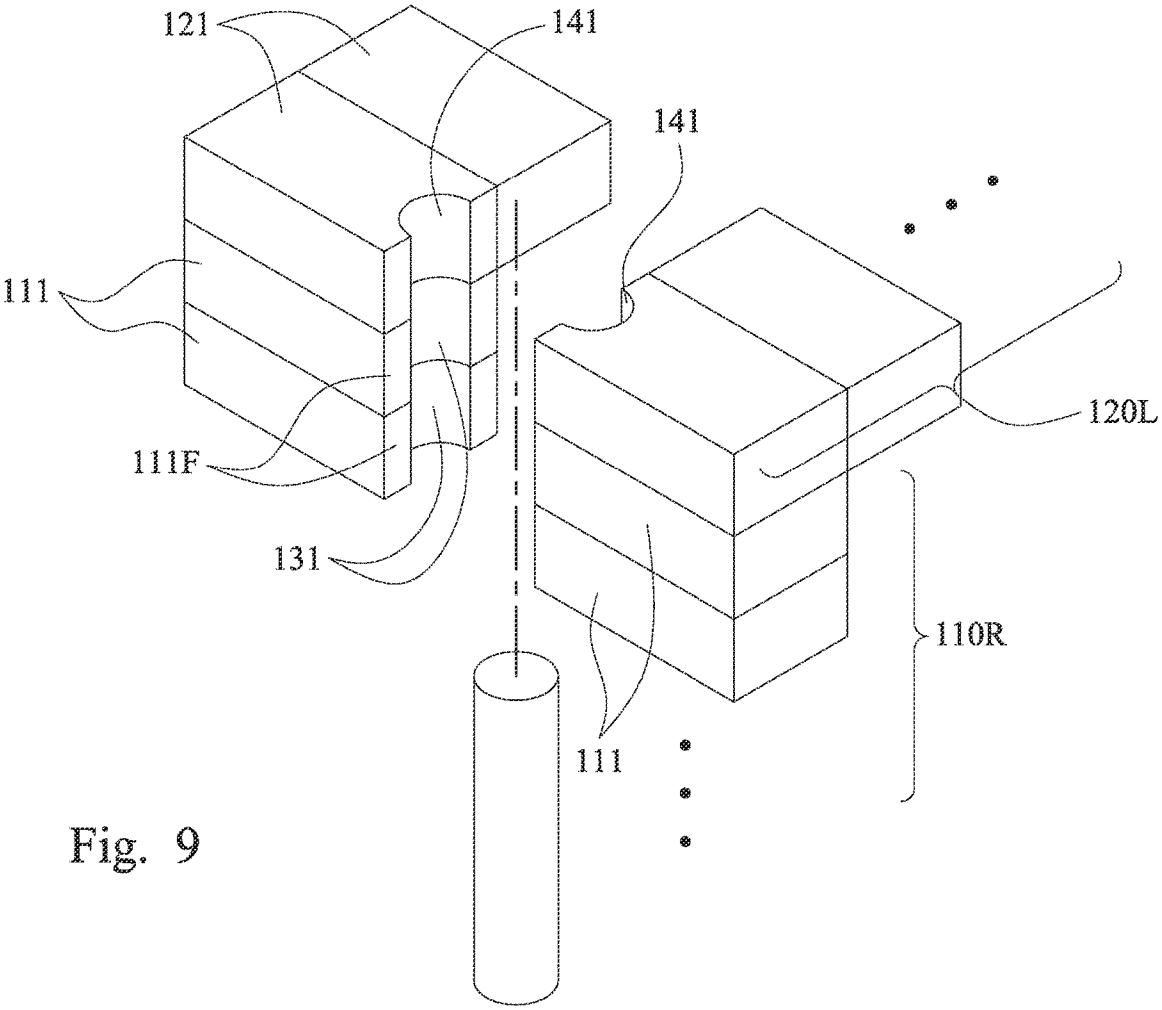
FIG. 9 is a partially exploded view of a first magnetic block, a second magnetic block and a heat conduction pipe of FIG. 7.

FIG. 9 is a partially exploded view of a first magnetic block 111, a second magnetic block 121 and a heat conduction pipe 300 of FIG. 7. Refer to FIG. 9, specifically, every two mutually facing sides 111F of every two adjacent ones of the first magnetic blocks 111 which are arranged abreast have a first recess 131, respectively. After the two adjacent first magnetic blocks 111 are combined together, the two first recesses 131 of the adjacent first magnetic blocks 111 are mutually combined to form a first passage 130 (FIG. 8) which extends in an alignment direction S of the first magnetic blocks 111. Similarly, two mutually facing sides of the outermost two of the second magnetic blocks 121 which are adjacent to each other and arranged abreast respectively have a second recess 141. After the two ones of the second magnetic blocks 121 are combined together, the two second recesses 141 of the adjacent second magnetic blocks 121 are mutually combined to form a second passage 140 (FIG. 8) which extends in the alignment direction S. The second passage 140 of every one of the magnetic plates 120 covering the same magnetic column 110 is in communication with all of the first passages 130 in the same magnetic column 110.

Therefore, the two column parts 110R of the same magnetic column 110 are arranged abreast, and the two row parts 120L of the respective magnetic plate 120 covering the same magnetic column 110 are arranged abreast, the heat conduction pipe 300 can insert into all of the first passages 130 of the same magnetic column 110 and the second passages 140 which are in communication with all of the first passages 130, and the heat conduction pipe 300 is disposed in all of the first passages 130 and the second passages 140.

Further, in the fourth embodiment, the heat conduction pipe 300 of the magnetic element 40 is not limited to use the described thermally conductive adhesive 800 for being fixed between the two adjacent column parts 110R and between the two adjacent row parts 120L. For example, the heat conduction pipe 300 is bonded in the first passages 130 by the described thermally conductive adhesive 800. More specifically, the heat conduction pipe 300 is bonded in all of the first passages 130 respectively located between the two adjacent first magnetic blocks 111 arranged abreast. Likewise, the heat conduction pipe 300 of the fourth embodiment is bonded in the second passages 140 by the thermally conductive adhesive 800 being integral with the thermally conductive adhesive 800 in the first passages. Please refer to the described features, thus no further illustration is provided.

However, one person with ordinary skill in the art also could select to fix the heat conduction pipe 300 between the two adjacent column parts 110R arranged abreast, and between the two adjacent row parts 120L arranged abreast by the described mechanical expansion process base on the instructions of the first embodiment. For example, with the described mechanical expansion process, the heat conduction pipe 300 in the first passages 130 can directly contact with the inner walls of the recesses, and tightly couples to the two adjacent first magnetic blocks 111 arranged abreast in the recesses. The heat conduction pipe 300 of the fourth embodiment, also can be fixed in the second passages 140 with the described mechanical expansion process, so that the heat conduction pipe 300 in the second passages 140 can directly contact with the inner walls of the recesses, and tightly couples to the two adjacent second magnetic blocks 121 arranged abreast in the recesses. Please refer to the described features, thus no further illustration is provided.

Fifth Embodiment

Figure 10:
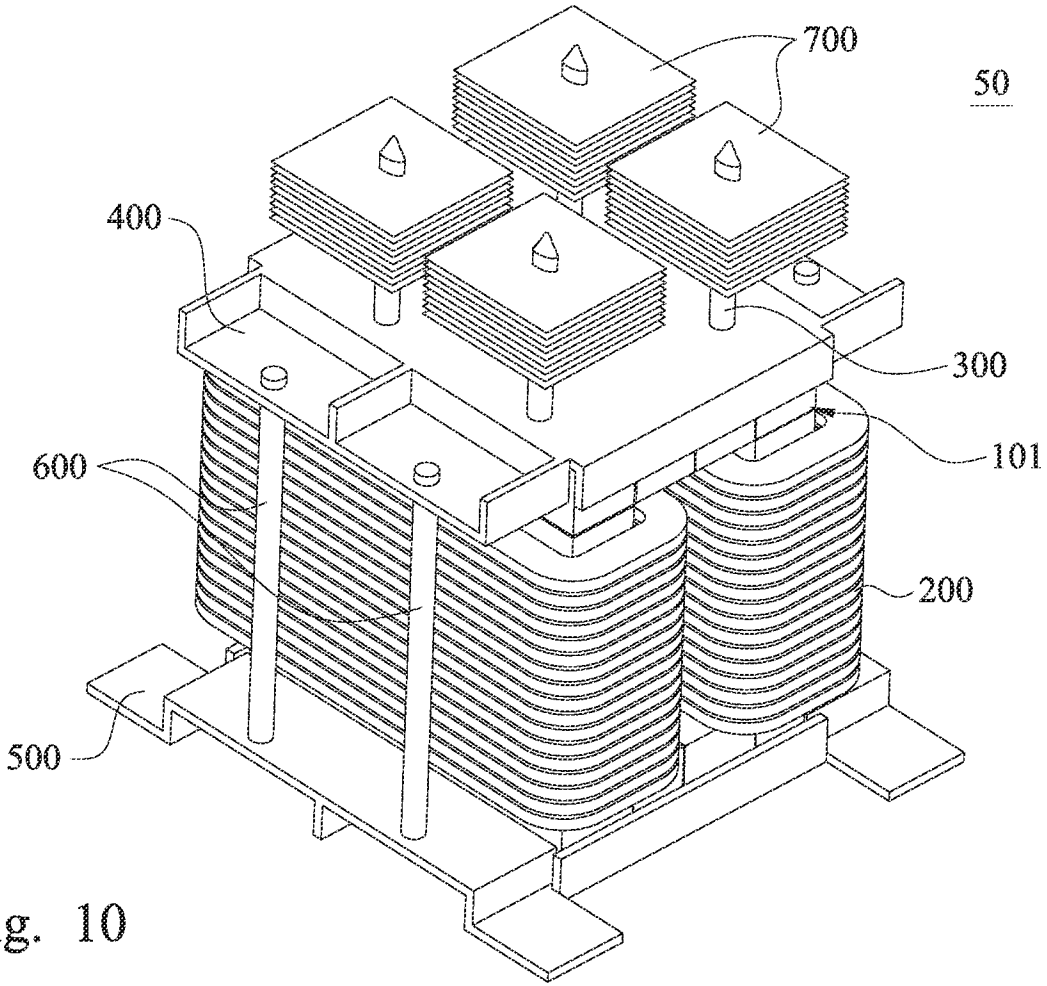
FIG. 10 is a perspective view of a magnetic element according to a fifth embodiment of the disclosure.

FIG. 10 is a perspective view of a magnetic element 50 according to a fifth embodiment of the disclosure. Refer to FIG. 10, the magnetic element 50 of the fifth embodiment is applicable to all of the above-mentioned embodiments, and includes an upper clamp part 400, a lower clamp part 500 and a plurality of screws 600. The upper clamp part 400 is coupled to one of the magnetic plates 120 of the magnetic core 100. The lower clamp part 500 is opposite to the upper clamp part 400, and is coupled to the other of the magnetic plates 120 of the magnetic core 100. The screws 600 are connected to both of the upper clamp part 400 and the lower clamp part 500, so that the magnetic core 100 is sandwiched between the upper clamp part 400 and the lower clamp part 500.

Furthermore, the magnetic element 50 further includes at least one cooling fin set 700. Each of the heat conduction pipes 300 is arranged with one cooling fin set 700, and the heat conduction pipe 300 is in contact with the cooling fin set 700. Therefore, the heat conducted outwards from the heat conduction pipe 300 can be rapidly dissipated into to the atmosphere.

In the fifth embodiment, the assembly sequences of the magnetic element 50 are outlined as follows. Step 1: Refer to FIG. 5, a plurality of second magnetic blocks 121 are bonded together to form the lower one of the magnetic plates 120 of FIG. 5 by the adhesive part 112 (e.g., epoxy adhesives); Step 2: Refer to FIG. 6, two heat conduction pipes 300 are receptively inserted into the second through holes 123 of the outermost two of the second magnetic blocks 121 of the lower one of the magnetic plates 120; Step 3: a plurality of first magnetic blocks 111 are stacked together to make the two magnetic columns 110 which are arranged at two opposite sides of the lower one of the magnetic plates 120 of FIG. 5. Refer to FIG. 6, the first through hole 113 reserved on each of the first magnetic blocks 111 needs to approach the corresponding heat conduction pipes 300 from up to down so that the corresponding heat conduction pipes 300 can insert into the first through hole 113, and the thermally conductive adhesive 800 is preliminarily applied in the gap defined between the first magnetic blocks 111 so as to form the column parts 110R. Gaps defined between every two adjacent ones of the first magnetic blocks 111 of the magnetic column 110 are respectively inserted by first non-magnetic conduction layers 111S (e.g., insulation papers or epoxy boards) so as to maintain air gaps therebetween; Step 4: Refer to FIG. 5, two winding sets 200 are respectively bound on the two magnetic columns 110; Step 5: The upper one of the magnetic plates 120 of FIG. 5 is made and then assembled to the two magnetic columns 110 in which the heat conduction pipes 300 respectively go through the second through holes 123 of the outermost two of the second magnetic blocks 121 of the upper one of the magnetic plates 120; Step 6: by the above-mentioned mechanical expansion process, the heat conduction pipes 300 respectively expands to tightly connect to the first magnetic blocks 111 in the first through holes 113, and to the second magnetic blocks 112 in the second through holes 123; otherwise, the second through holes and the first through holes also can be respectively applied with thermally conductive adhesives sequentially in steps 2, 3 and 5, so that the heat conduction pipes 300 are bonded with the second magnetic blocks and the first magnetic blocks; Step 7: refer to FIG. 10, the magnetic core 101 are fixed by using the upper clamp part 400, the lower clamp part 500 and the screws 600; and Step 8: the heat conduction pipes 300 is pressed to be installed with the cooling fin sets 700. The coupling of the cooling fin sets 700 and the heat conduction pipes 300 is not limited to mechanical crimping methods or using the thermally conductive adhesives to fix the cooling fin sets 700 and the heat conduction pipes 300. In the entire assembly sequences of the magnetic element 50, each of the heat conduction pipes can be a positioning post to ensure the reliability of the magnetic core being assembled, and to guarantee the well-connection of the first (or second) magnetic blocks and the heat conduction pipe.

In the above-mentioned embodiments, refer to FIG. 3 again, the conduction pipe 300 includes a pipe body 310 and a working fluid 314. The pipe body 310 includes a sealing chamber 311 therein. The working fluid 314 is disposed in a part of the space of the sealing chamber 311. The working fluid 314 can be water, acetone, refrigerant (e.g., R134a) or liquid ammonia etc.

Also, the heat conduction pipe 300 includes a porous capillary structure 312. The porous capillary structure 312 is formed on an inner wall of the sealing chamber 311 of the pipe body 310. Furthermore, the porous capillary structure 312 is a capillary structure having metal powders sintered thereon, a capillary structure having metal meshes thereon, a grooved capillary structure or at least two of the above-mentioned capillary structures. The heat conduction pipe, for example, can be a heat tube, a liquid-cooled tube, a solid high-thermal conduction tube or a magnetic-fluid tube. However, the type of the heat conduction pipes is not limited to the above-mentioned embodiments.

Separately speaking, when the above-mentioned heat conduction pipe is a heat tube, the heat tube includes a vacuum metal cavity in which two opposite ends of the vacuum metal cavity are sealed. The porous capillary structure is formed on the inner walls of the vacuum metal cavity. The porous capillary structure may be a capillary structure having metal powders sintered thereon, a capillary structure having metal meshes thereon, a grooved capillary structure or a combination of at least two of the above-mentioned capillary structures. Also, a little working fluid is filled into the internal of the vacuum metal cavity. When the magnetic element is in operation, heat generated by the magnetic core is conducted to the heat tube, the working fluid absorbed by the porous capillary structure of the inner walls of the vacuum metal cavity will be heated to transform into steam gas. The steam gas in the vacuum metal cavity flows to a cool section thereof to be condensed into liquids, and the liquids flow back to an endothermic section of the heat tube with the porous capillary structure. Thus, the heat tube dissipates heats for the magnetic core. An interior portion of the heat tube disposed in the magnetic core is defined as the endothermic section of the heat tube, and the remaining portion of the heat tube disposed outwards the magnetic core is defined as the cool section of the heat tube.

When the above-mentioned heat conduction pipe is a liquid-cooled tube, the liquid-cooled tube is a well-conductive metal tube communicated to a liquid cooling circulation system so that cooling liquids cyclically flow in the liquid-cooled tube. Thus, when the magnetic element is in operation, heat generated by the magnetic core is conducted to the liquid-cooled tube, then to the cooling liquids of the liquid-cooled tube via the well-conductive metal tube, and next, the heat is brought away by the cooling liquids. Thus, the liquid-cooled tube dissipates heats for the magnetic core.

When the above-mentioned heat conduction pipe is a magnetic-fluid tube, the magnetic-fluid tube is a sealed metal tube with well-conductive characteristics in which the sealed metal tube is internally filled with magnetic fluid. The magnetic fluid is driven to flow in the magnetic-fluid tube for conducting the heat out of the magnetic core by using the temperature characteristics of the magnetic fluid (i.e., the magnetism is getting weaker as the temperature of the magnetic fluid increases, and the magnetism is getting greater as the temperature of the magnetic fluid decreases).

In the aforementioned embodiments, other than the kind of the heat conduction pipe having the working fluid therein, another heat conduction pipe also can be a solid high-thermal conduction tube. The material of the solid high-thermal conduction tube is copper, aluminum, graphite or a combination of at least two of the above-mentioned materials. Thus, when the magnetic element is in operation, heat generated by the magnetic core is conducted to the high-thermal conduction tube, and next, the heat is brought out of the high-thermal conduction tube. Thus, the high-thermal conduction tube dissipates heats for the magnetic core.

It is noted that the magnetic elements of the above-mentioned embodiments can be a reactor or a transformer, which can be applicable in the related fields of the reactor and the transformer, such as, a power inverter, a medium/high variable-frequency drive, an uninterruptible power system (UPS) or a power quality management equipments as long as conforming the aforementioned structures of the disclosure.

In addition, although the magnetic core of each of the aforementioned embodiments is respectively embodied with a single-phase double column magnetic core made by two magnetic columns and two, i.e., upper and lower, magnetic plates. However, the disclosure is in not limited to the single-phase double column magnetic core, in other embodiments, a three-phase three-column magnetic core or a three-phase five-column magnetic core also can be belonged to the scope of the magnetic core of the magnetic element in the disclosure. The three-phase three-column magnetic core is made by two outer lateral magnetic columns, a middle magnetic column arranged between the outer lateral magnetic columns, and two, i.e., upper and lower, magnetic plates, and the three-phase five-column magnetic core is made by two outer lateral magnetic columns, three middle magnetic columns arranged between the outer lateral magnetic columns, and two, i.e., upper and lower, magnetic plates.

In addition, the express "stack" described in this specification of the disclosure is not only limited to mutually superimpose the magnetic blocks vertically (e.g., up and down directions), but also to mutually superimpose the magnetic blocks abreast (e.g., left and right directions), or to mutually superimpose the magnetic blocks according to the other direction.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A magnetic element, comprising:

a magnetic core comprising:

at least two magnetic columns arranged oppositely, each of the magnetic columns comprising a plurality of first magnetic blocks stacked together, wherein each of the first magnetic blocks is provided with at least one through hole, and the through holes of the first magnetic blocks of each of the magnetic columns are in communication with each other, each of the through holes comprises a middle section located in the respective first magnetic block; and two openings respectively located at two opposite ends of the middle section, and the openings being respectively disposed on two opposite end surfaces of the respective first magnetic block, wherein a maximum caliber of each of the openings is greater than a caliber of the middle section; and at least two magnetic plates arranged oppositely, respectively covering two opposite end surfaces of each of the magnetic columns to mutually form a closed magnetic flux path with the magnetic columns, and each of the magnetic plates comprising at least one second magnetic block;

at least one winding set binding at least one of the magnetic columns; and at least one heat conduction pipe disposed in an interior of one of the magnetic columns, and penetrating through the through holes of the first magnetic blocks of each of the magnetic columns.

2. The magnetic element according to claim 1, wherein the magnetic plates and at least one of the magnetic columns are penetrated through by the heat conduction pipe.

3. The magnetic element according to claim 1, wherein a quantity of the at least one heat conduction pipe being disposed in the interior of the same magnetic column is plural.

4. The magnetic element according to claim 1, wherein the first magnetic blocks being penetrated through by the same heat conduction pipe extend in a stacking direction, wherein the stacking direction and the length direction of the heat conduction pipe are the same.

5. The magnetic element according to claim 1, wherein the magnetic core comprises a thermally conductive adhesive, and the heat conduction pipe is bonded in the through holes by the thermally conductive adhesive.

6. The magnetic element according to claim 1, wherein the heat conduction pipe expands to be secured in the through holes, such that the heat conduction pipe tightly connects to the first magnetic blocks in the through holes.

7. The magnetic element according to claim 1, wherein each of the openings comprises a chamfer therein.

8. The magnetic element according to claim 1, wherein the first magnetic blocks are stacked to form the magnetic columns arranged abreast, and the heat conduction pipe is disposed between two adjacent ones of the first magnetic blocks being arranged abreast, wherein the length direction of the heat conduction pipe and an alignment direction of the first magnetic blocks being arranged abreast are orthogonal to each other.

9. The magnetic element according to claim 1, wherein the first magnetic blocks are stacked to form the magnetic columns arranged abreast, every two mutually facing sides of two adjacent ones of the first magnetic blocks being arranged abreast respectively have a recess, the recesses of the mutually facing sides of the adjacent first magnetic blocks of the magnetic columns are mutually combined to form a passage which is located between the adjacent first magnetic blocks of the magnetic columns being arranged abreast, and the heat conduction pipe is disposed in the passage, wherein an alignment direction of the first magnetic blocks being arranged abreast and the length direction of the heat conduction pipe is orthogonal to each other.

10. The magnetic element according to claim 9, wherein the magnetic core comprises a thermally conductive adhesive, and the heat conduction pipe is bonded in the passage by the thermally conductive adhesive.

11. The magnetic element according to claim 9, wherein the heat conduction pipe expands to be secured in the passage, such that the heat conduction pipe directly contacts inner walls of the recesses to tightly connect to the two adjacent first magnetic blocks.

12. The magnetic element according to claim 1, wherein the heat conduction pipe comprises:

a pipe body comprises a sealing chamber therein; and a working fluid disposed in a part of a space of the sealing chamber.

13. The magnetic element according to claim 12, wherein the heat conduction pipe comprises:

a porous capillary structure formed on an inner wall of the sealing chamber of the pipe body.

14. The magnetic element according to claim 13, wherein the porous capillary structure is a capillary structure having metal powders sintered thereon, a capillary structure having metal meshes thereon or a combination of the capillary structure having metal powders sintered thereon and the capillary structure having metal meshes thereon.

15. The magnetic element according to claim 1, wherein the heat conduction pipe is one of a heat tube, a liquid-cooled tube, a solid high-thermal conduction tube and a magnetic-fluid tube.

16. The magnetic element according to claim 1, further comprising:

a cooling fin set being in contact with the heat conduction pipe.

17. The magnetic element according to claim 1, further comprising:

an upper clamp part coupled to one of the magnetic plates of the magnetic core;

a lower clamp part being opposite to the upper clamp part, and coupled to the other of the magnetic plates of the magnetic core; and a plurality of screws connected to both of the upper clamp part and the lower clamp part, such that the magnetic core is sandwiched between the upper clamp part and the lower clamp part.

18. The magnetic element according to claim 1, wherein the at least one winding set comprises a plurality of turns, and the turns surround the magnetic columns.

19. The magnetic element according to claim 18, wherein every two adjacent ones of the turns have an interval therebetween.

20. The magnetic element according to claim 1, wherein a first gap is defined between every two adjacent ones of the first magnetic blocks, the at least one second magnetic block is plural, and the second magnetic blocks are stacked together, and a second gap is defined between every two adjacent ones of the second magnetic blocks.

21. The magnetic element according to claim 20, further comprising:

a first non-magnetic conduction layer disposed in the first gap, and sandwiched between every two of the first magnetic blocks; and a second non-magnetic conduction layer disposed in the second gap, and sandwiched between every two of the second magnetic blocks.

22. The magnetic element according to claim 1, wherein any of the first magnetic blocks and the at least one second magnetic block comprises:

an adhesive body;

a plurality of metal magnetic particles distributed in the adhesive body; and an insulating cover layer wrapping on outer surfaces of the adhesive body.

23. The magnetic element according to claim 1, wherein each of the first magnetic blocks and each of the at least one second magnetic block are the same in size.

24. The magnetic element according to claim 1, wherein the magnetic element is a reactor or a transformer.

* * * * *